US008919305B2

(12) United States Patent
Volckart

(10) Patent No.: US 8,919,305 B2
(45) Date of Patent: Dec. 30, 2014

(54) CYLINDER FOR A COMBUSTION ENGINE AND A METHOD FOR MAKING THE SAME

(75) Inventor: Lutz Volckart, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 397 days.

(21) Appl. No.: 13/227,824

(22) Filed: Sep. 8, 2011

(65) Prior Publication Data

US 2012/0060788 A1 Mar. 15, 2012

(30) Foreign Application Priority Data

Sep. 14, 2010 (DE) ..... 10 2010 045 332

(51) Int. Cl.

| | |
|---|---|
| ***F02B 25/00*** | (2006.01) |
| ***F02B 25/14*** | (2006.01) |
| ***F02F 1/22*** | (2006.01) |
| ***F02B 75/16*** | (2006.01) |
| ***F02F 1/00*** | (2006.01) |
| *F02F 3/24* | (2006.01) |
| *F02B 75/02* | (2006.01) |

(52) U.S. Cl.

CPC . *F02F 1/002* (2013.01); *F02F 3/24* (2013.01); *F02B 25/14* (2013.01); *F02F 1/22* (2013.01); *F02B 2075/025* (2013.01); *F02B 75/16* (2013.01)

USPC ..... 123/73 R; 123/65 R

(58) Field of Classification Search

USPC ..... 123/73 R, 195 C, 65 R, 73 A

See application file for complete search history.

(56) References Cited

U.S. PATENT DOCUMENTS 7,066,120 B2 * 6/2006 Geyer et al. ..... 123/73 PP

FOREIGN PATENT DOCUMENTS

DE 1 912 287 U 3/1965

* cited by examiner

*Primary Examiner* — Noah Kamen
*Assistant Examiner* — Omar Morales
(74) *Attorney, Agent, or Firm* — Walter Ottesen P.A.

(57) ABSTRACT

A cylinder (2) for a combustion engine has a cylinder bore (42) and a cylinder wall (43). At least one channel is formed in the cylinder wall (43). At least one cover (19), which at least partially closes the channel on the side facing away from the cylinder bore (42), is arranged on the cylinder (2). A very precise channel geometry which can be easily manufactured is achieved in that a first stop (25) is formed in the longitudinal direction of the cylinder between the cylinder (2) and the cover (19) and a second stop (33) is formed in the tangential direction with respect to the cylinder bore (42), with the cover (19) resting on the cylinder (2) at the first stop (25) and at the second stop (33). In the method, the cover (19) is arranged on the cylinder (2) in a first direction (41) radial to the cylinder bore (42) and the cover (19) is shifted in a second direction (40) which is parallel to a plane which is approximately peripherally to the cylinder bore (42) and parallel to the longitudinal cylinder axis (45), until the cover (19) rests on the cylinder (2) at the first stop (25) and at the second stop (33).

14 Claims, 5 Drawing Sheets

CYLINDER FOR A COMBUSTION ENGINE AND A METHOD FOR MAKING THE SAME

CROSS REFERENCE TO RELATED APPLICATION

This application claims priority of German patent application no. 10 2010 045 332.3, filed Sep. 14, 2010, the entire content of which is incorporated herein by reference.

FIELD OF THE INVENTION

The invention relates to a cylinder for a combustion engine and a method for making the cylinder.

BACKGROUND OF THE INVENTION

DE 1 912 287 discloses a cylinder for a combustion engine whose transfer channels are closed laterally by covers fixed on the cylinder. The covers can be secured on the cylinder via a rivet connection, adhesive connection or a clamped connection.

Especially with covers which delimit the transfer channels in the area of the transfer channel openings, an exact positioning on the cylinder is necessary in order to achieve the desired channel geometry. When fixing covers, however, a gap is required between the cylinder and the cover so that the cover is guided with clearance on the cylinder in the longitudinal direction of the cylinder and in the peripheral direction of the cylinder.

SUMMARY OF THE INVENTION

It is an object of the invention to provide a cylinder of the generic type which is simply constructed and has a desired channel geometry. It is a further object of the invention to provide a method for producing the cylinder.

The cylinder unit of the invention is for a combustion engine and includes: a cylinder having a cylinder wall defining a cylinder bore; the cylinder defining a cylinder longitudinal direction; the cylinder wall having a channel formed therein and the channel having a side facing away from the cylinder bore; a cover arranged on the cylinder which at least partially closes the channel on the side thereof; a first stop formed between the cylinder and the cover in the cylinder longitudinal direction; a second stop formed between the cylinder and the cover in tangential direction to the cylinder bore; and, the cover lying on the cylinder and being configured to rest on the first stop and the second stop.

The cylinder unit is made in accordance with the method of the invention which includes the steps of:

arranging the cover on the cylinder in a first direction approximately radial to the cylinder bore; and, displacing the cover in a second direction parallel to a plane running approximately tangential to the cylinder bore and parallel to the cylinder longitudinal direction until the cover comes to rest on the first stop and the second stop.

The stops in the longitudinal direction of the cylinder and in tangential direction with respect to the cylinder bore enable precise positioning of the cover in these directions. By a corresponding arrangement of the stops, a desired gap width between the cover and the cylinder, for example as an adhesive gap, can furthermore be specified. The stops are, in this case, advantageously arranged adjacent to the geometries critical to functionality so that short tolerance chains result and a very precise positioning can be achieved in these areas.

In the area of the stops, the cover and cylinder can be manufactured with high precision in order to achieve very precise positioning with little effort.

Advantageously, a peripheral ridge is provided on at least one of the two components, cylinder and cover, and projects into a peripheral groove in the other component. The ridge and the groove can be configured as a sealing contour or in particular also as an adhesive contour. Advantageously, on each of the cylinder and the cover there is formed a groove and a ridge, between which a gap having an approximately S-shaped cross-section is formed. The ratio of the depth of the groove to the width of the groove is, in particular, approximately 1.0 to approximately 3.0.

Advantageously, the gap widths on both longitudinal sides of the groove are approximately the same size. A gap width of approximately 0.2 mm to approximately 0.8 mm has been shown to be particularly advantageous.

The cover is, in particular, adhesively bonded onto the cylinder, with adhesive surfaces advantageously being formed at least on the longitudinal sides of the groove. For an adhesive bond, shear loading is advantageous. Advantageous shear loading of the adhesive surfaces is achieved on account of the outward orientation of the longitudinal sides of the groove, that is, in the direction of the load. When the cross-section of the gap is configured in an S-shaped manner, large adhesive surfaces result and ensure a high loading capacity and strength of the connection. Pre-positioning of the cover on the cylinder is achieved on account of the interlocking of groove and ridge. The final positioning takes place via the first and the second stop.

The positioning of the cover on the cylinder advantageously takes place automatically. For this, it is provided that the cover has at least one contact point for an actuating device on its outer side facing away from the cylinder bore. The setting arrangement can, for example, be a pneumatic or electric slide valve or the like. In order to enable the lateral movement of the cover on the stop, in particular the surface of the contact point and/or the setting arrangement is disposed in the direction perpendicular to the plane of the cover.

In order to enable the production of the cylinder in a die casting process even with complicated channel geometries, it is provided that the cover has a rib which projects into the channel and delimits the channel. As a result, the channel geometries between the cylinder and cover can for the most part be configured freely. In order to achieve a good flow-guidance in the area of the opening of the channel to the cylinder bore, it is provided that the distance of the rib from the cylinder bore is less than approximately 0.8 mm. As a result, good flow conditions can be achieved. The rib advantageously has a thickness of approximately 0.8 mm to approximately 2.0 mm on its front end which faces the cylinder bore. The resulting shift in the flow cross-section of the channel in the area of the front end of the rib can thus be kept comparatively small so that the effect of the rib on the flow in this area remains acceptable. At the same time, the specified thicknesses can be achieved in a simple manufacturing process. In particular, at least one stop is formed on a rib which projects into the channel and delimits the channel.

A simple configuration results when two channels which run adjacent to each other are closed by a common cover.

For a method for manufacturing a cylinder for a combustion engine, wherein the cylinder has a cylinder bore and a cylinder wall, wherein at least one channel is formed in the cylinder wall, wherein at least one cover is arranged on the cylinder and at least partially closes the channel on the side facing away from the cylinder bore, and wherein between the cylinder and the cover a first stop is formed in the longitudinal direction of the cylinder and a second stop is formed in a tangential direction with respect to the cylinder bore, it is provided that in a first step the cover is arranged on the cylinder in a first direction approximately radially to the cylinder bore, and that in a second step the cover is shifted in a second direction, which is parallel to a plane running approximately tangentially to the cylinder bore and parallel to the longitudinal direction of the cylinder, until the cover rests on the cylinder at the first stop and at the second stop. In this way, precise positioning of the cover on the cylinder can be achieved in a simple manner.

Advantageously, a peripheral ridge is provided on at least one of the two components, the cylinder and the cover, the ridge projecting into a peripheral groove in the other component, wherein a gap is formed between the ridge and the groove and has a first gap width on a first longitudinal side of the groove and a second gap width on a second longitudinal side of the groove which runs parallel to the first longitudinal side, wherein the first and the second gap widths have different sizes after the cover has been arranged on the cylinder in the first direction, and wherein, when the cover is shifted in a second direction, the first and the second gap widths are changed at the first and the second stops in such a manner that after the cover has been shifted they are approximately the same size. A defined gap width can be constructively provided in a simple manner an account of the arrangement of the gap relative to the stops. As a result, high precision can be achieved. As a result of the defined shifting of the cover up to the stops, an essentially constant gap width can be constructively provided. As a result, a high strength of the connection can be ensured, especially when the cover is adhesively bonded on the cylinder.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
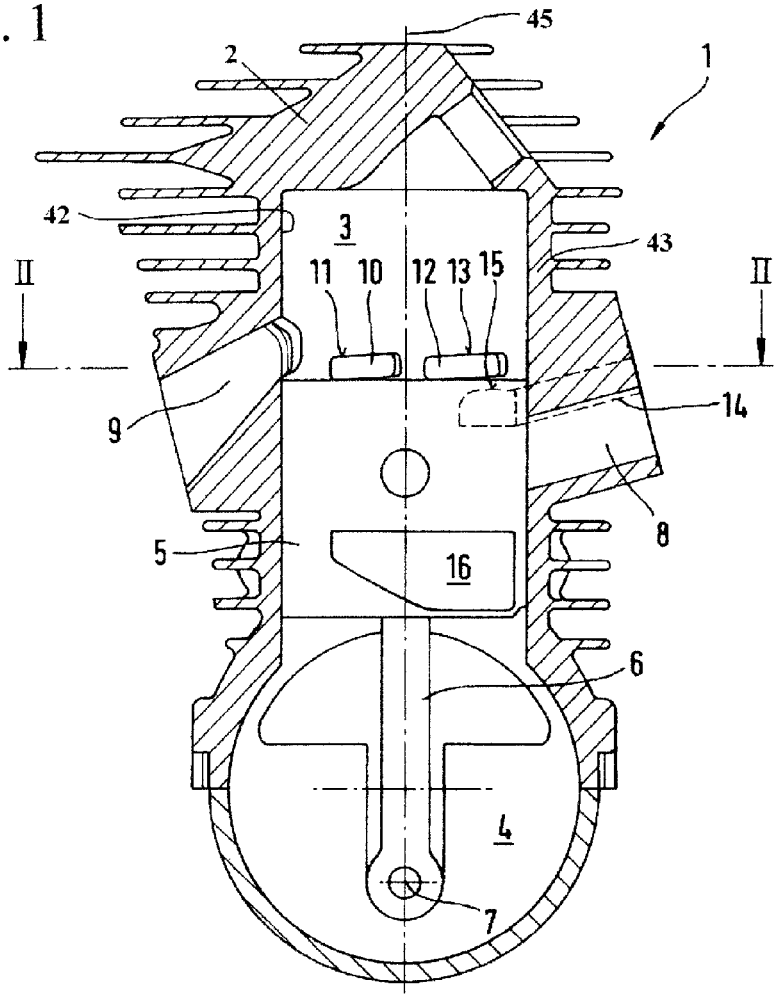
FIG. 1 shows a schematic longitudinal section through a combustion engine in the direction of line I-I in FIG. 2.
Figure 2:
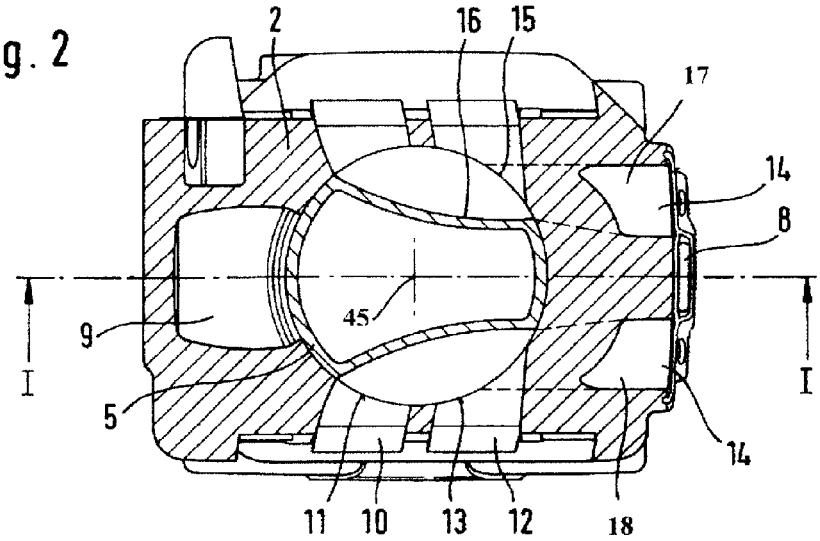
FIG. 2 shows a schematic section through a cylinder along the line II-II in FIG. 1.

A two-stroke engine 1 is schematically shown in FIGS. 1 and 2 as an exemplary embodiment of a combustion engine. The two-stroke engine 1 is a fast-running engine with a small cylinder capacity and serves, for example, as a drive motor in handheld tool such as a chain saw, a cut-off machine, a brush cutter or the like.

The two-stroke engine 1 has a cylinder 2 in which a combustion chamber 3 is formed. The combustion chamber 3 is delimited by a piston 5 which drives a crankshaft 7 via a connecting rod 6, the crankshaft 7 being rotatably mounted in a crankcase 4. The cylinder 2 has a cylinder wall 43 which delimits a cylinder bore 42. A mixture channel 8 which is slot-controlled by the piston 5 opens at the cylinder bore 42. Furthermore, an air channel 14 opens at the cylinder bore 42 and, in the area of the cylinder 2, divides into the two branches (17, 18), shown in FIG. 2, which each open at the cylinder bore 42 with an air inlet 15. In the area of the top dead center of the piston 5, the air inlet 15 is connected to transfer windows 11 and 13 of transfer channels 10 and 12 via a respective piston pocket 16 provided on the piston 5. An outlet 9 slot-controlled by the piston 5 leads out of the combustion chamber 3. The two transfer channels 10 which are close to the outlet and the two transfer channels 12 which are close to the inlet connect the crankcase 4 to the combustion chamber 3 in the area of the bottom dead center, shown in FIG. 1, of the piston 5, so that fuel/air-mixture can flow into the combustion chamber 3 from the crankcase 4. In the cylinder 2, the piston 5 moves in the direction of a longitudinal cylinder axis 45.

During operation, fuel/air mixture is drawn via the mixture channel 8 into the crankcase 4 in the area of the top dead center of the piston 5. At the same time, air or a low-fuel mix from air channel 14 is temporarily stored in the transfer channels 10 and 12. During the down-stroke of the piston 5 the fuel/air mixture is compressed into the crankcase 4. As soon as the piston 5 opens the transfer windows 11 and 13, first of all the temporarily stored air flows out of the transfer channels 10 and 12 into the combustion chamber 3 and flushes out exhaust gases from the previous engine cycle which are still present in the combustion chamber 3 through the outlet 9. Subsequently, fuel/air mixture flows out of the crankcase 4 into the combustion chamber 3. During the upward stroke of the piston 5, the mixture in the combustion chamber 3 is compressed and is ignited by a spark plug, not shown, in the area of the top dead center of the piston 5. The subsequent combustion accelerates the piston 5 in the direction of the crankcase 4. As soon as the outlet 9 is opened by the piston 5, the exhaust gases flow out of the combustion chamber 3 and are flushed out by the air of the next engine cycle temporarily stored in the transfer channels 10 and 12.

Figure 3:
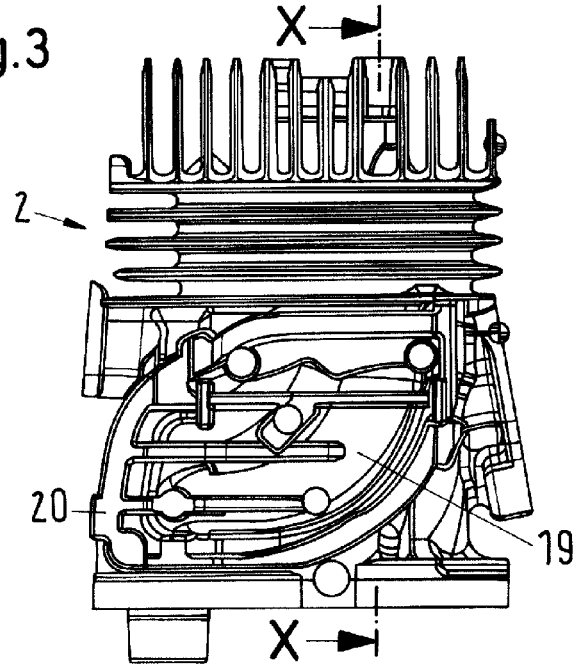
FIG. 3 shows a side view of a cylinder.

The cylinder 2 is manufactured in a die-casting process. The transfer channels 10 and 12 are closed toward the outside of the cylinder by covers 19, of which one is shown in FIG. 3, in order that the transfer channels 10 and 12, too, can be manufactured in a die-casting process. The covers 19 are not shown in FIG. 2, so that the transfer channels 10 and 12 are open toward the outside of the cylinder in this illustration. As FIG. 3 shows, the cover 19 has a peripheral edge 20.

For the manufacture of the two-stroke engine 1, the two covers 19, which are configured in a mirror-symmetrical manner with respect to each other, are automatically positioned on the cylinder 2. For positioning, the cylinder 2 has contact points 31 for an actuating device and the cover 19 has contact points 30 on which one or more setting arrangements can act.

Figure 4:
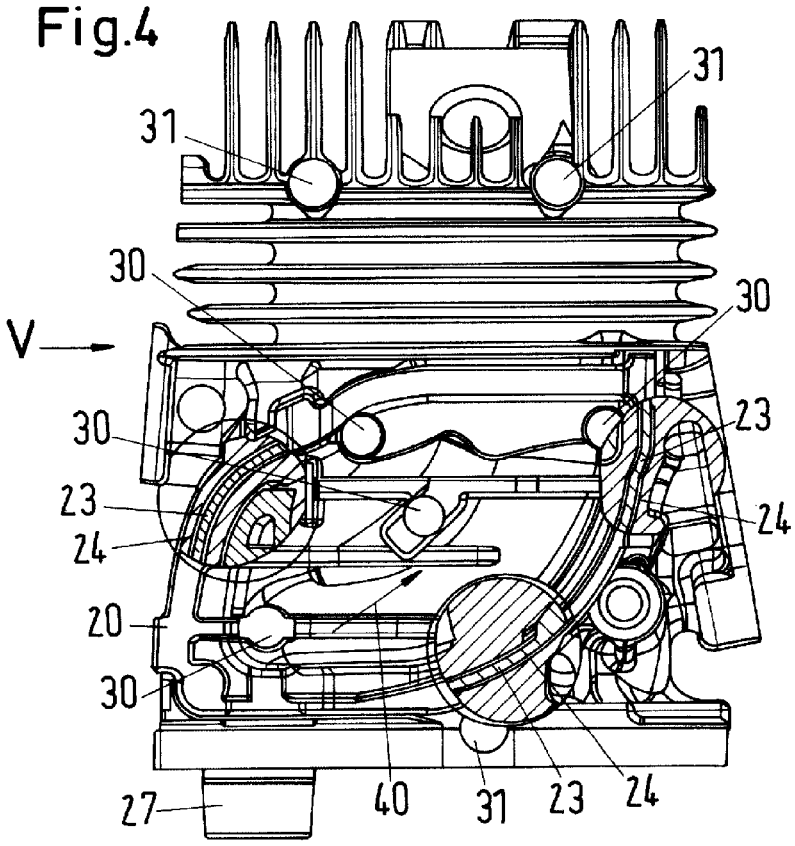
FIG. 4 shows a partially sectioned side view of the cylinder from FIG. 3.
Figure 5:
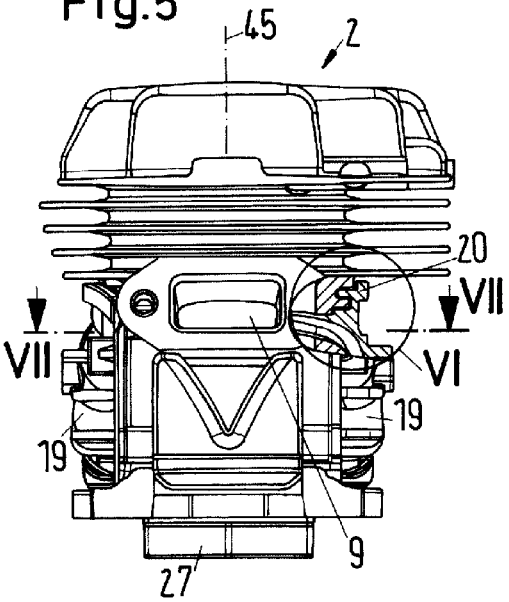
FIG. 5 shows a partially sectioned side view in the direction of the arrow V in FIG. 4.

As the partially sectioned areas in FIG. 4 show, the cover 19 has at its edge 20 a peripheral ridge 23, which projects into a groove 24 in the cylinder 2. The ridge 23 and the groove 24 run around the entire edge 20. As is indicated in FIGS. 3 to 5, the transfer channels 10 and 12 are guided under the outlet 9. For this, the cylinder 2 has a connecting stub 27 which projects into the area of the crankcase 4 and in which the transfer channels 10 and 12 are guided into the crankcase 4 from both sides of the cylinder 2.

Figure 6:
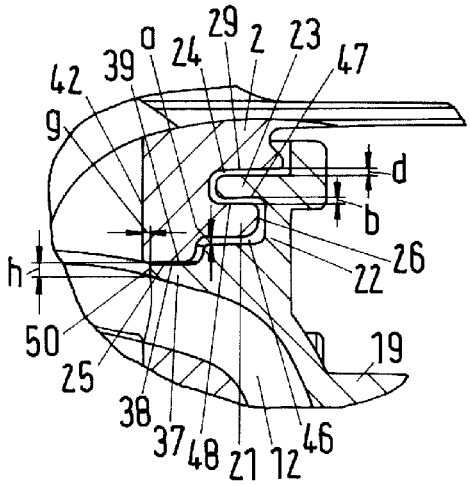
FIG. 6 shows the detail VI from FIG. 5 in an enlarged view.

FIG. 6 shows in detail the configuration of the cylinder 2 and the covers 19 in the upper area which is adjacent to the combustion chamber 3. Adjacent to the transfer window 13, a rib 37 of the cover 19 projects, on the side facing away from the crankcase 4, into transfer channel 12, the rib 37 delimiting the transfer channel 12 at its upper wall which is adjacent to the combustion chamber 3. The rib 37 has a distance (g) from the cylinder bore 42 which is advantageously configured to be as small as possible. The distance (g) must, however, be chosen such that it is ensured that the rib 37 cannot project into the cylinder bore 42 even with unfavorable manufacturing tolerances. Advantageously, the distance (g) is less than 0.8 mm. This has a minimal impact on the flow in the transfer channel. At its front end 50, which faces the cylinder bore 42, the rib 37 has a thickness (h), which is advantageously approximately 0.8 mm to 2 mm. The rib 37 has a contact surface 38 which faces away from the transfer channel 12 and which rests on a contact surface 39 of the cylinder 2 and together therewith forms a first stop 25 in the direction of the longitudinal cylinder axis 45.

As FIG. 6 shows, a gap 26 is formed between the cover 19 and the cylinder 2, the cross-section of said gap 26 having an approximately S-shaped contour. The cylinder 2 has a ridge 21 and the adjoining groove 24 on the side facing away from the transfer channel 12. The ridge 23 on the cover 19 projects into the groove 24. The ridge 21 on the cylinder 2 is arranged in a groove 22 in the cover 19. The groove 22 has a first longitudinal side 46 facing the transfer channel 12 and a second longitudinal side 47, which is parallel to the first longitudinal side 46 and faces away from the transfer channel 12. Correspondingly, the groove 24 in the cylinder 2 has a first longitudinal side 48, which is arranged opposite the second longitudinal side 47 of the groove 22, and also a second longitudinal side 49. The gap 26 has a gap width (a) on its first longitudinal side 46, a gap width (b) between the second longitudinal side 47 and the first longitudinal side 48 and a gap width (d) adjacent to the second longitudinal side 49. The gap widths a, b and d are essentially of equal size. The cover 19 is adhesively bonded on the cylinder 2. In the areas of the longitudinal sides 46, 47, 48 and 49, the adhesive surface which is formed in the gap 26 is under shear loading. Because the outwardly extending longitudinal sides 46 to 49 are configured in a comparatively wide manner, a large adhesive surface results and thus a high retention force of the cover 19 on the cylinder.

Figure 7:
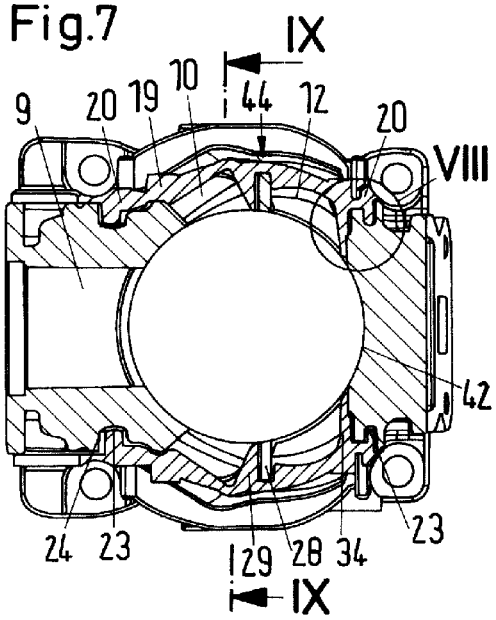
FIG. 7 shows a section through the cylinder at the level of the line VII-VII in FIG. 5.
Figure 8:
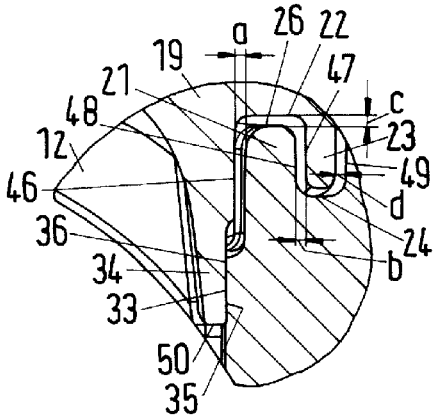
FIG. 8 shows the detail VIII from FIG. 7 in an enlarged view.

FIGS. 7 and 8 show that side of the cover 19 which runs approximately in the direction of the longitudinal cylinder axis 45 and is arranged adjacent to the mixture inlet 8. At the transfer channel 12 close to the inlet, a rib 34 is formed on each cover 19 and projects up to close to the cylinder bore 42 and delimits the transfer channel 12. The rib 34 has, as shown in FIG. 8, a front end 50 whose dimensions and distance from the cylinder bore 42 correspond advantageously to those of the rib 37. The rib 34 has a lateral contact surface 36 on which a lateral contact surface 35 of the cover 19 rests. The two contact surfaces 35 and 36 form a stop 33 for the cover 19, on which the cover 19 rests in the tangential direction with respect to the cylinder bore.

As FIG. 8 shows, the ridges 21 and 23 and the grooves 22 and 24 are also formed on the sides of the cylinder running in the vertical direction of the cylinder 2. The longitudinal sides 46, 47, 48 and 49, too, are configured in a corresponding manner. The same is true of the distances a, b and d. As FIG. 8 shows, the ridge 21 is at a distance from the groove base of the groove 22 which is arranged between the longitudinal sides 46 and 47. In this area, the gap 26 has a gap width (c). The gap width (c) is advantageously approximately the same size as the gap widths a, b and d.

Figure 9:
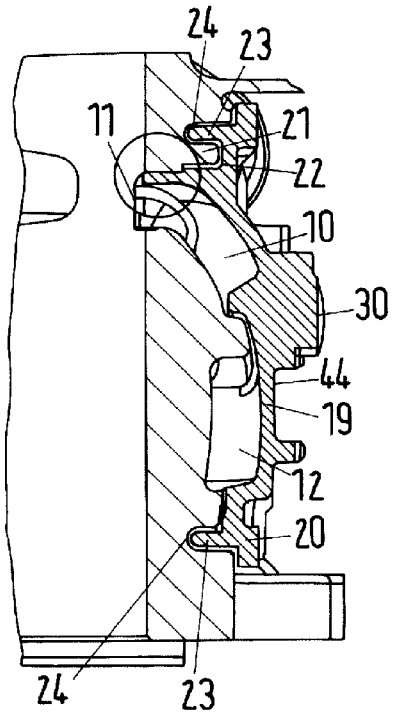
FIG. 9 shows a section along the line IX-IX in FIG. 7.
Figure 10:
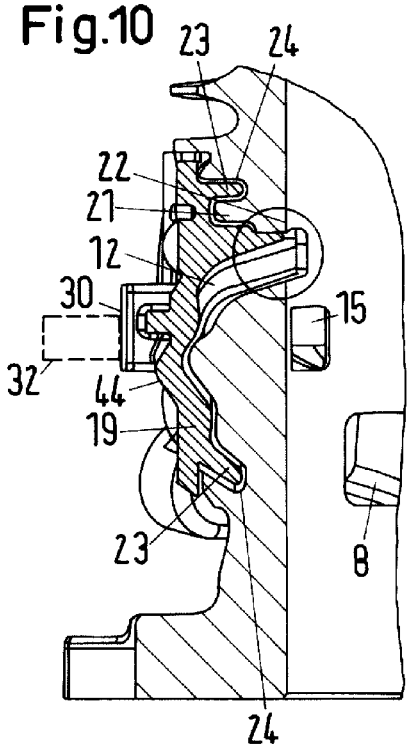
FIG. 10 shows a section along the line X-X in FIG. 3.

FIGS. 9 and 10 show longitudinal sections through the cylinder 2 in the area of the transfer window 11 which is close to the outlet and in the area of the transfer window 13 which is close to the inlet. As FIG. 9 shows, in the area of the transfer window 11 of the transfer channel 10 which is close to the outlet, the transfer channel 12 which is close to the inlet runs on that side of the transfer channel 10 which faces the crankcase 4. Both of the transfer channels (10, 12) are guided under the outlet 9.

Figure 11:
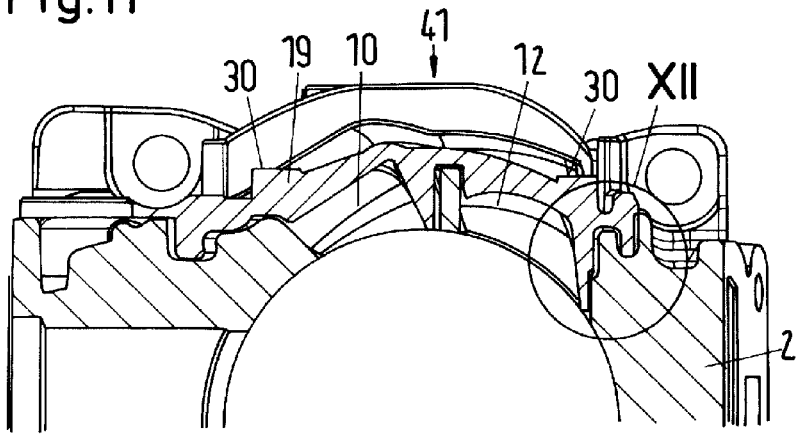
FIG. 11 shows the cylinder with cover according to the view from FIG. 7 prior to the shifting of the cover; and, FIG. 12 shows the detail XII from FIG. 11 in an enlarged view.

As FIGS. 9 and 10 also show, the ridge 23 and the groove 24 are configured in a peripheral manner. The ridge 23 extends over the entire edge 20 of the cover 19. The ridge 21 and the groove 22 are arranged only in the upper area which faces the combustion chamber and also in the top section of the cover 19 which is close to the inlet. FIG. 11 shows that no ridge 21 and no groove 22 are provided in the area of the top side close to the outlet.

Figure 12:
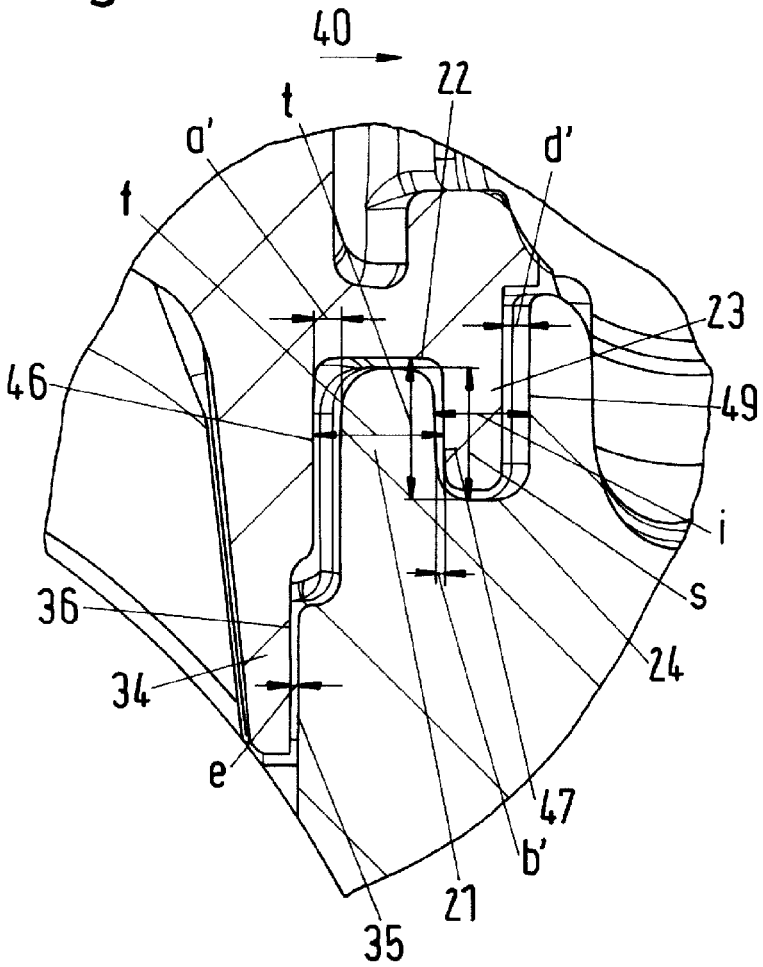

The cover 19 has the contact points 30 on its outer side 44 which faces away from the cylinder bore 42. One or more setting arrangements 32 act on the contact points 30 during the mounting of the cover 19 on the cylinder 2. The setting arrangements 32 can, for example, be pneumatic cylinders. The contact points 30 can run parallel to the longitudinal cylinder axis 45 or be slightly inclined with respect thereto. For the mounting of the cover 19, the cover 19 is initially arranged on the cylinder 2, specifically in the direction 41 shown in FIG. 11. The direction 41 is radial to the cylinder bore 42. As FIG. 12 shows, after the cover 19 has been arranged on the cylinder 2, the lateral contact surface 36 of the cover 19 is at a distance e from the contact surface 35 of the cylinder 2. The gap 26 has a gap width (a') on the longitudinal side 46 and a gap width (a'), which is substantially smaller than the gap width (a'), on the opposite longitudinal side 47. The gap width (d') on the longitudinal side 49 corresponds approximately to the gap width (a'). After the cover 19 has been arranged on the cylinder 2, the cover 19 is shifted in a direction 40 (see also FIG. 4) in the tangential direction with respect to the cylinder bore toward the inlet of the mixture channel 8 and in the direction of the longitudinal cylinder axis 45 toward the combustion chamber 3 until the cover 19 rests on the two stops 25 and 33. The lateral movement toward the exterior of the cylinder in the direction 40 is carried out by the setting arrangement 32. Because it is ensured that the cover 19 rests against both stops 25 and 33, the cover 19 is precisely positioned in relation to the cylinder 2. After the cover 19 has been shifted in the direction of the arrow 40, the gap widths a, b and d are the same size, as is shown in FIGS. 6 and 8.

In order to achieve a firm adhesive bond of the cover 19 on the cylinder 2, it is provided that the depth (t) of the groove 22 is approximately one to three times the width (f) of the groove 22. The depth (s) of the groove 24 is, advantageously, likewise approximately one to three times the width (i) of the groove 24. As a result, large adhesive surfaces and a firm connection of the cover 19 on the cylinder 2 is achieved.

Each cover 19 delimits both transfer channels (10, 12) toward the exterior of the cylinder. A rib 28 is arranged on the cylinder 2 between the transfer channels (10, 12). Adjacent to the rib 28, a rib 29 which delimits the transfer channel 10 close to the outlet, is, as shown in FIG. 7, formed on the cover 19. The rib 29 is advantageously also at a distance of less than approximately 0.8 mm from the cylinder bore. As a result, a favorable flow relationship is achieved.

It is understood that the foregoing description is that of the preferred embodiments of the invention and that various changes and modifications may be made thereto without departing from the spirit and scope of the invention as defined in the appended claims.

What is claimed is:

1. A method for making a cylinder unit for a combustion engine which includes: a cylinder having a cylinder wall defining a cylinder bore; said cylinder defining a cylinder longitudinal direction; said cylinder wall having a channel formed therein and said channel having a side facing away from said cylinder bore; a cover having a peripheral edge and being arranged on said cylinder which at least partially closes said channel on said side thereof; a first stop formed between said cylinder and said cover in said cylinder longitudinal direction; and, a second stop formed between said cylinder and said cover in cylinder peripheral direction to said cylinder bore; said cylinder being a first component and said cover being a second component; a peripheral groove arranged on at least one of said components; said groove having two mutually opposite-lying longitudinal sides; the other one of said components having a peripherally extending ridge projecting into said groove; said groove and said ridge conjointly defining an adhesive contour gap therebetween; said gap extending along said peripheral edge of said cover and said gap having a first gap width (a, b) at a first one of said longitudinal sides; said gap having a second gap width (b, d) at a second one of said longitudinal sides running parallel to said first one of said longitudinal sides; the method comprising the steps of:

arranging said cover on said cylinder in a first direction approximately radial to said cylinder bore with said first gap width (a, b) and said second gap width (b, d) having respectively different magnitudes after said cover has been arranged on said cylinder in said first direction;

displacing said cover in a second direction until said cover comes to rest on said first stop and said second stop wherein said second direction lies parallel to a plane running approximately tangentially to said cylinder bore and parallel to said cylinder longitudinal direction and extends in the cylinder peripheral direction of said cylinder bore as well as in the direction of the cylinder longitudinal axis; and, wherein said first gap width (a, b) and said second gap width (b, d) so change when displacing said cover in said second direction against said first stop and said second stop that said first gap width (a, b) and said second gap width (b, d) are of approximately the same magnitude after the displacement of said cover; and applying adhesive to adhesively bonding said cover to said cylinder.

2. The method of claim 1, wherein said cover has an outer side facing away from said cylinder bore; said cover has at least one bearing point on said outer side thereof; the method comprising the further steps of:

providing at least one positioning device to assemble said cover; and, causing said positioning device to act on said bearing point when assembling said cover on said cylinder.

3. A cylinder unit for a combustion engine comprising:

a cylinder having a cylinder wall defining a cylinder bore;

said cylinder defining a cylinder longitudinal direction;

said cylinder wall having a channel formed therein and said channel having a side facing away from said cylinder bore;

a cover having a peripheral edge and being arranged on said cylinder which at least partially closes said channel on said side thereof;

a first stop formed between said cylinder and said cover in said cylinder longitudinal direction;

a second stop formed between said cylinder and said cover in cylinder peripheral direction to said cylinder bore;

said cover lying on said cylinder and being configured to rest on said first stop and said second stop;

said cylinder being a first component and said cover being a second component;

a peripheral groove arranged on at least one of said components;

said groove having two mutually opposite-lying longitudinal sides;

the other one of said components having a peripherally extending ridge engaging into said groove;

said groove and said ridge conjointly defining an adhesive contour gap therebetween at said longitudinal sides;

said gap extending along said peripheral edge of said cover and said gap having a gap width of at least approximately 0.2 mm at said longitudinal sides; and, adhesive disposed in said gap for adhesive bonding said cover to said cylinder.

4. The cylinder unit of claim 3, wherein said peripheral groove has a depth (s, t) and a width (f, i); and, the ratio of said depth (s, t) to said width (f, i) lies in a range of approximately 1.0 to approximately 3.0.

5. The cylinder unit of claim 3, wherein adhesive surfaces are formed at said longitudinal sides of said groove.

6. The cylinder unit of claim 3, wherein said cover has a rib projecting into said channel and delimiting said channel; and, said rib is at a distance (g) to said cylinder bore of less than approximately 0.80 mm.

7. The cylinder unit of claim 6, wherein said rib has an end facing toward said cylinder bore; and, said rib has a thickness (h) at said end lying in a range of approximately 0.8 mm to approximately 2.0 mm.

8. The cylinder unit of claim 3, wherein said cover has a rib projecting into said channel and delimiting said channel; and, said cover has at least one stop formed on said rib.

9. The cylinder unit of claim 3, wherein said channel is a first channel; said cylinder has a second channel formed therein; said first and second channels run side-by-side; and, said cover is common to both of said first and second channels and closes off said first and second channels.

10. The cylinder unit of claim 3, wherein said groove defines a groove base running between said two mutually opposite-lying longitudinal sides; said gap is formed also at said groove base; and, said gap at said groove base also has a gap width of at least approximately 0.2 mm.

11. The cylinder unit of claim 10, wherein the gap widths of said gap at said longitudinal sides and said groove base are approximately of the same magnitude.

12. The cylinder unit of claim 3, wherein said gap formed between said groove and said ridge has an approximate S-shape when viewed in cross section.

13. The cylinder unit of claim 3, wherein said gap has a first gap width (a, b) on a first one of said longitudinal sides of said groove and said gap has a second gap width (b, d) on a second one of said longitudinal sides of the groove; and, said first gap width (a, b) and said second gap width (b, d) are approximately the same size.

14. The cylinder unit of claim 13, wherein said first gap width (a, b) and said second gap width (b, d) lie in a range of approximately 0.2 mm to approximately 0.8 mm.

* * * * *

UNITED STATES PATENT AND TRADEMARK OFFICE

CERTIFICATE OF CORRECTION

PATENT NO. : 8,919,305 B2
APPLICATION NO. : 13/227824
DATED : December 30, 2014
INVENTOR(S) : Lutz Volckart It is certified that error appears in the above-identified patent and that said Letters Patent is hereby corrected as shown below:

In the Specification

In column 6:
Line 35: delete "(a')," and substitute -- (b'), -- therefor.

In the Claims

In column 7:
Line 47: -- said gap for -- should be added before "adhesively".

Signed and Sealed this
Fourteenth Day of April, 2015

Michelle K. Lee

Michelle K. Lee
*Director of the United States Patent and Trademark Office*